US010855033B2

(12) United States Patent
Liu

(10) Patent No.: US 10,855,033 B2
(45) Date of Patent: Dec. 1, 2020

(54) ELECTRICAL CONNECTOR WITH STABILITY ASSURANCE FOR INTERNAL SHIELDING PLATE AND THE ATTACHMENT OF AN EXTERNAL ELECTRICAL COMPONENT

(71) Applicant: LOTES CO., LTD, Keelung (TW)

(72) Inventor: Jun Liu, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/590,585

(22) Filed: Oct. 2, 2019

(65) Prior Publication Data

US 2020/0112129 A1 Apr. 9, 2020

(30) Foreign Application Priority Data

Oct. 9, 2018 (CN) ..... 2018 1 1170242

(51) Int. Cl.
*H01R 13/6585* (2011.01)
*H01R 13/502* (2006.01)
*H01R 13/627* (2006.01)

(52) U.S. Cl.
CPC ..... *H01R 13/6585* (2013.01); *H01R 13/502* (2013.01); *H01R 13/6273* (2013.01)

(58) Field of Classification Search
CPC ..... H01R 13/648; H01R 13/6581; H01R 13/6583; H01R 13/6593; H01R 12/71
USPC ..... 439/357
See application file for complete search history.

(56) References Cited

U.S. PATENT DOCUMENTS

| | | | | |
|---|---|---|---|---|
| 9,281,626 | B2 * | 3/2016 | Lin | H01R 13/6581 |
| 9,362,695 | B2 * | 6/2016 | Yu | H01R 13/6582 |
| 9,444,204 | B2 * | 9/2016 | Yen | H01R 24/78 |
| 9,698,537 | B2 * | 7/2017 | Yokoyama | H01R 13/648 |
| 9,728,885 | B2 * | 8/2017 | Yokoyama | H01R 13/6585 |
| 9,761,981 | B2 * | 9/2017 | Oyake | H01R 13/6275 |
| 2015/0270661 | A1 * | 9/2015 | Kao | H01R 13/516 439/271 |
| 2015/0288107 | A1 * | 10/2015 | Wu | H01R 13/6593 439/357 |

(Continued)

FOREIGN PATENT DOCUMENTS

| | | | |
|---|---|---|---|
| CN | 205029053 | U | 2/2016 |
| CN | 105470733 | A | 4/2016 |

*Primary Examiner* — Peter G Leigh
(74) *Attorney, Agent, or Firm* — Locke Lord LLP; Tim Tingkang Xia, Esq.

(57) ABSTRACT

An electrical connector is used to electrically connect a first component and a second component. The electrical connector includes: an insulating block; multiple terminals provided to form two rows including an upper row and a lower row; and a shielding sheet, fixed to the insulating block and located between the two rows of the terminals. Each terminal has a connecting portion fixed in the insulating block, a first conduction portion extending forward from the horizontal section to be electrically connected to the first component, and a second conduction portion extending backward from the horizontal section. The second conduction portion has a bending portion, and the bending portion is connected to the horizontal section. A rear end of the shielding sheet has an abutting portion to abut the second component. The abutting portion extends backward out of an insulating body and does not pass beyond the bending portion.

19 Claims, 10 Drawing Sheets

(56) References Cited

U.S. PATENT DOCUMENTS

| | | | | |
|---|---|---|---|---|
| 2016/0006148 | A1* | 1/2016 | Chung | H01R 13/6594 439/83 |
| 2016/0020569 | A1* | 1/2016 | Ju | H01R 12/712 439/607.01 |
| 2016/0156136 | A1* | 6/2016 | Kao | H01R 13/6585 439/607.05 |
| 2016/0181734 | A1* | 6/2016 | Kao | H01R 13/6474 439/607.05 |
| 2017/0194754 | A1* | 7/2017 | Tsai | H01R 24/60 |
| 2017/0222342 | A1* | 8/2017 | Ho | H01R 13/6585 |
| 2018/0159278 | A1* | 6/2018 | Zhao | H01R 13/6273 |

* cited by examiner

ELECTRICAL CONNECTOR WITH STABILITY ASSURANCE FOR INTERNAL SHIELDING PLATE AND THE ATTACHMENT OF AN EXTERNAL ELECTRICAL COMPONENT

CROSS-REFERENCE TO RELATED PATENT APPLICATION

This non-provisional application claims priority to and the benefit of, pursuant to 35 U.S.C. § 119(a), patent application Ser. No. CN201811170242.X filed in China on Oct. 9, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to a high-frequency electrical connector.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector used to electrically connect a socket connector and a circuit board includes an insulating body, two terminal modules, a shielding sheet and a metal shell. Each of the terminal modules includes an insulating block and a row of terminals provided on the insulating block to transmit high-speed signals. Each of the terminals has a fixing portion embedded in the insulating block, a contact portion extending forward from the fixing portion and electrically connected to a plug connector, and a soldering portion extending backward from the fixing portion. The soldering portion extends backward out of the insulating block and the insulating body and is electrically connected to the circuit board. The two terminal modules clamp the shielding sheet vertically, and are assembled to the insulating body together. The metal shell is sleeved outside the insulating body.

However, the rear end of the shielding sheet in the existing technology does not pass backward beyond the insulating block, such that no shielding sheet exists between the upper row and the lower row of the soldering portions for shielding, thereby causing crosstalk interference between the terminals in the upper row and the lower row, and affecting the high-frequency performance of the electrical connector.

Therefore, a heretofore unaddressed need to design a new electrical connector exists in the art to address the aforementioned deficiencies and inadequacies.

SUMMARY

The present invention is directed to an electrical connector, in which a rear end of a shielding sheet to backward abut a second component and does not pass beyond a bending portion of a conducting portion at a rear end of each terminal, thus ensuring stability of the shielding sheet and insertion of the second component.

In order to achieve the foregoing objective, the present invention adopts the following technical solutions:

An electrical connector is configured to electrically connect a first component and a second component. The electrical connector includes: an insulating block; a plurality of terminals, provided to form two rows including an upper row and a lower row, each of the terminals having a connecting portion fixed in the insulating block, a first conduction portion extending forward from the connecting portion to be electrically connected to the first component, and a second conduction portion extending backward from the connecting portion, wherein the second conduction portion has a bending portion, and the bending portion is connected to the connecting portion; and a shielding sheet, fixed to the insulating block and located between the two rows of the terminals, wherein a rear end of the shielding sheet has an abutting portion to abut the second component, and the abutting portion extends backward out of an insulating body and does not pass beyond the bending portion.

In certain embodiments, the second component is inserted forward between the second conduction portions of the terminals in the upper row and the lower row, the second component has a plurality of first pads divided into an upper row and a lower row and provided on an upper surface and a lower surface of the second component, each of the first pads is correspondingly in contact with the second conduction portion of a corresponding one of the terminals, and a tail end of the second conduction portion of the corresponding one of the terminals does not pass backward beyond a rear edge of each of the first pads.

In certain embodiments, the second conduction portion has a contact point in contact with a corresponding first pad of the first pads, a distance from the second contact point to the rear edge of the corresponding first pad is 0.75±0.1 mm, and a distance from the second contact point to the tail end of the second conduction portion is 0.6±0.1 mm.

In certain embodiments, a middle slot and a side slot are concavely provided on a middle portion of a rear end surface of the shielding sheet, the side slot is located at one side of the middle slot, and the abutting portion is formed between the middle slot and the side slot.

In certain embodiments, a concave depth of the middle slot is less than a concave depth of the side slot.

In certain embodiments, the shielding sheet has a base, the base has a positioning hole fixed to and matched with the insulating block, and a rear end of the base has the abutting portion abutting and in contact with the second component.

In certain embodiments, two latch arms respectively extend forward from two sides of the base and are configured to latch and fit with the first component, two pins respectively extend from two sides of a rear end of the base to be in electrical contact with the second component, one of the latch arms and one of the pins located on a same side pass through a straight line in a front-rear direction, and the abutting portion is located between the two pins.

In certain embodiments, the electrical connector further includes a metal shell provided in a cylindrical shape and sleeved outside the insulating block, wherein two fastening portions respectively protrude from the two sides of the base toward a left side and a right side, and the fastening portions abut the metal shell.

In certain embodiments, the shielding sheet has at least one positioning hole and at least one notch located in front of the positioning hole, the insulating block has an upper insulating block and a lower insulating block vertically matching each other, the upper insulating block has an upper matching surface facing the lower insulating block, the lower insulating block has a lower matching surface facing the upper insulating block, at least one positioning post and at least one position limiting protrusion are provided between the upper matching surface and the lower matching surface, the position limiting protrusion is located in front of the positioning post, the positioning post is accommodated in and fixed to the positioning hole, the position limiting protrusion is accommodated in the notch, and a height of the position limiting protrusion is greater than a height of the positioning post.

In certain embodiments, at least one stopping portion is located between the upper matching surface and the lower matching surface, and the stopping portion is at least partially located in front of the shielding sheet to stop the shielding sheet from moving forward.

In certain embodiments, two stopping portions are provided opposite to each other at an interval in a left-right direction, the two stopping portions form an opening running forward, and the shielding sheet is exposed in the opening.

In certain embodiments, the shielding sheet has a base, the positioning hole is provided on the base, a first protruding portion extends forward from the base, a second protruding portion is located on at least one side of the first protruding portion, the notch is formed between the first protruding portion and the second protruding portion, the first protruding portion is exposed in the opening, and the stopping portions are provided in front of the second protruding portion to stop the second protruding portion from moving forward.

In certain embodiments, the first protruding portion is partially accommodated in the opening, and the two stopping portions are located at a left side and a right side of the first protruding portion to stop the first protruding portion from moving in the left-right direction.

In certain embodiments, two second protruding portions are provided so as to form two notches corresponding to two position limiting protrusions, and the two position limiting protrusions are located at a left side and a right side of the first protruding portion to stop the first protruding portion from moving in the left-right direction.

In certain embodiments, a side surface of the first protruding portion forms a stopping surface facing one of the two position limiting protrusions, the one of the position limiting protrusions has a position limiting surface provided face-to-face with the stopping surface, a protection slot is concavely provided on the upper matching surface or the lower matching surface, a projection of the protection slot in a vertical direction overlaps with a projection of the first protruding portion in the vertical direction, and a side wall of the protection slot and the position limiting surface are located on a same plane.

In certain embodiments, the protection slot extends forward into the opening.

In certain embodiments, each of an upper edge and a lower edge of the stopping surface is respectively provided with a first chamfer.

In certain embodiments, each of an upper edge and a lower edge of a front end surface of each of the second protruding portions is respectively provided with a second chamfer.

Compared with the related art, the second conduction portion has a bending portion connected to the connecting portion. The abutting portion is exposed at the rear of the insulating block and located between the upper row and the lower row of the second conduction portions, and the abutting portion does not pass backward beyond the bending portion, thereby reducing the crosstalk interference between the upper and lower rows of the second conduction portions, ensuring the sufficient insertion depth for the second component, and facilitating the second component to be fixed to the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
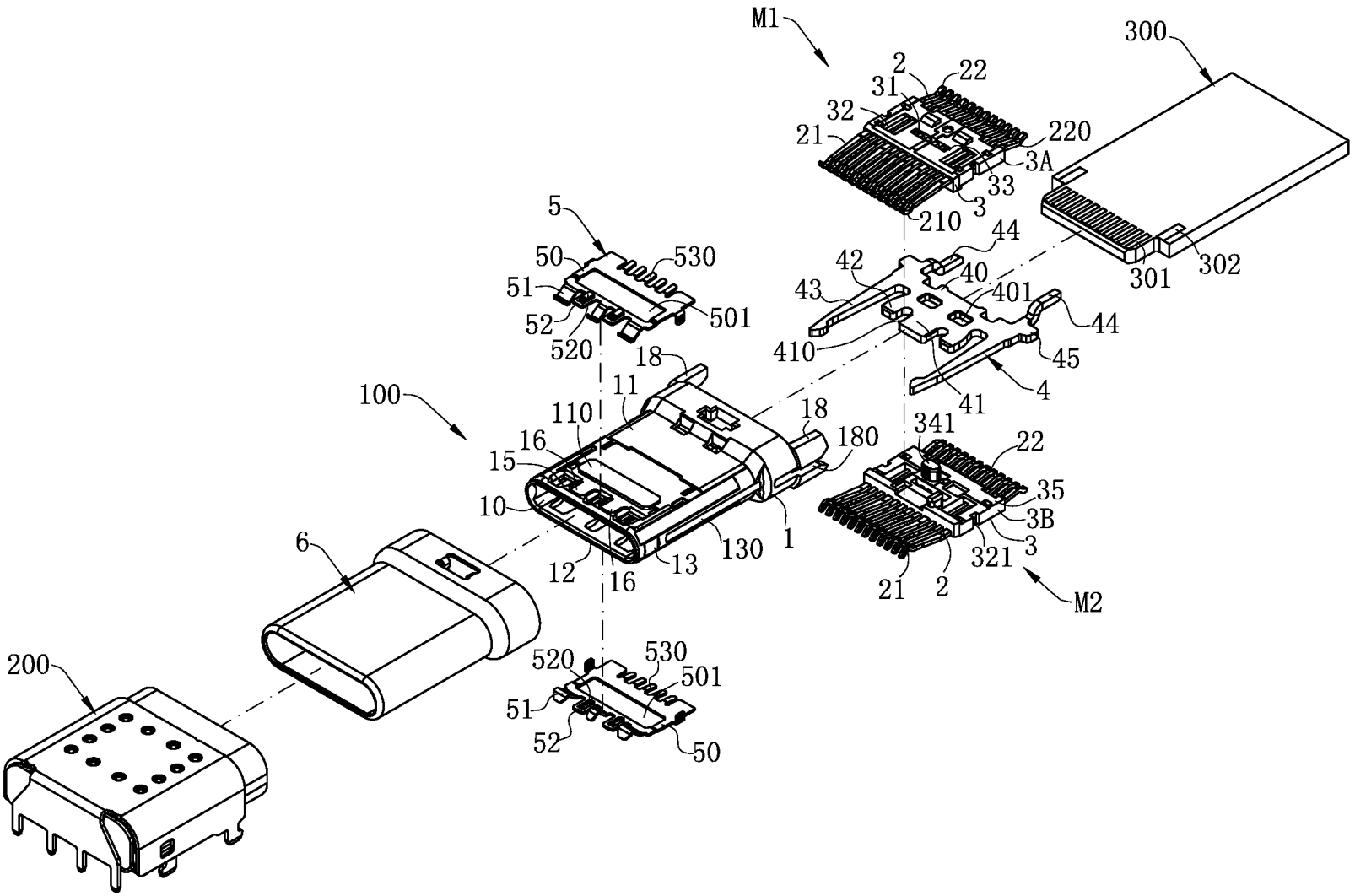
FIG. 1 is a perspective exploded view of the electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in"

includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-10. In accordance with the purposes of this invention, as embodied and broadly described herein, this invention, in one aspect, relates to an electrical connector.

Figure 2:
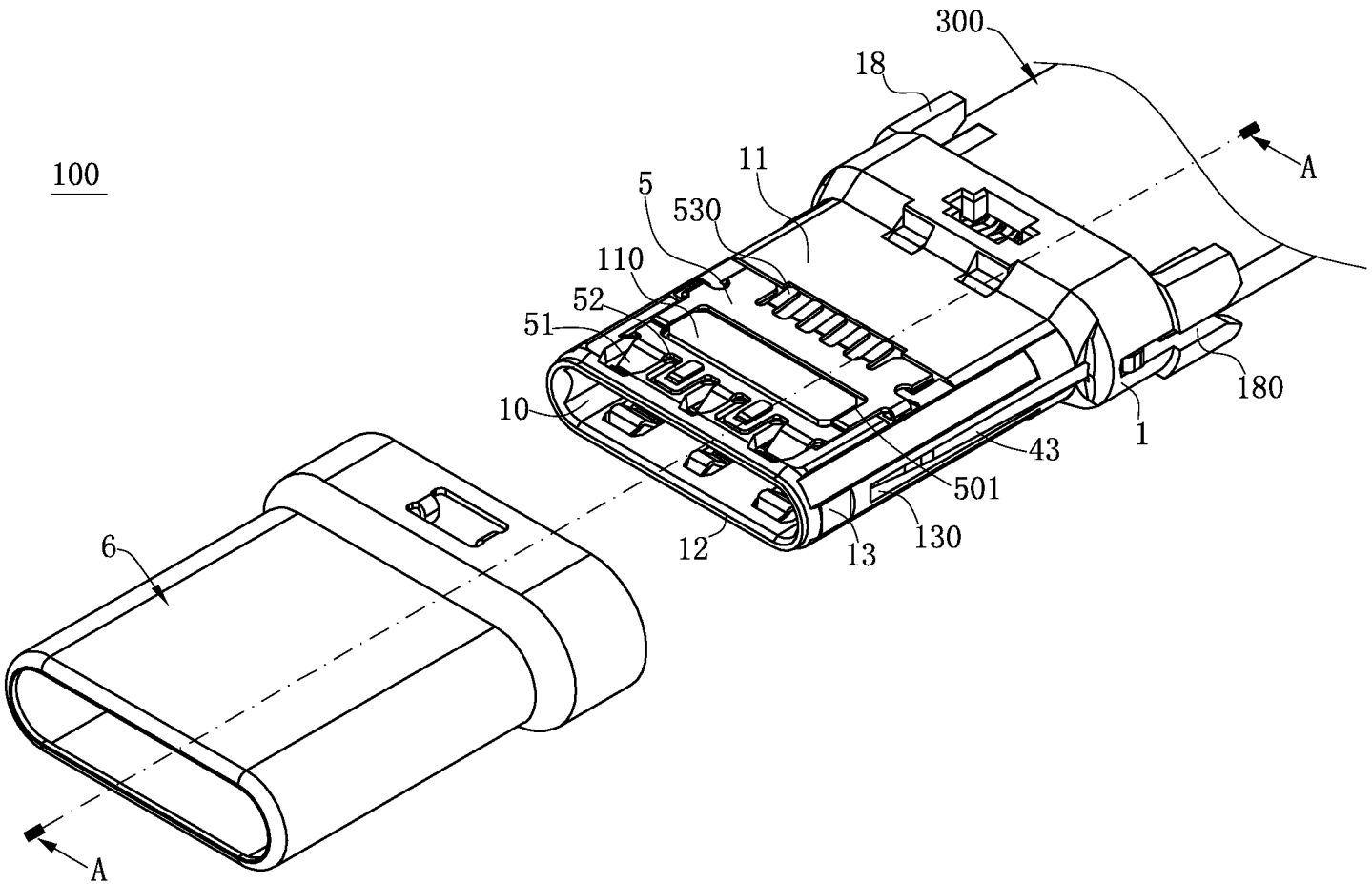
FIG. 2 is a perspective view of the electrical connector of FIG. 1.
Figure 3:
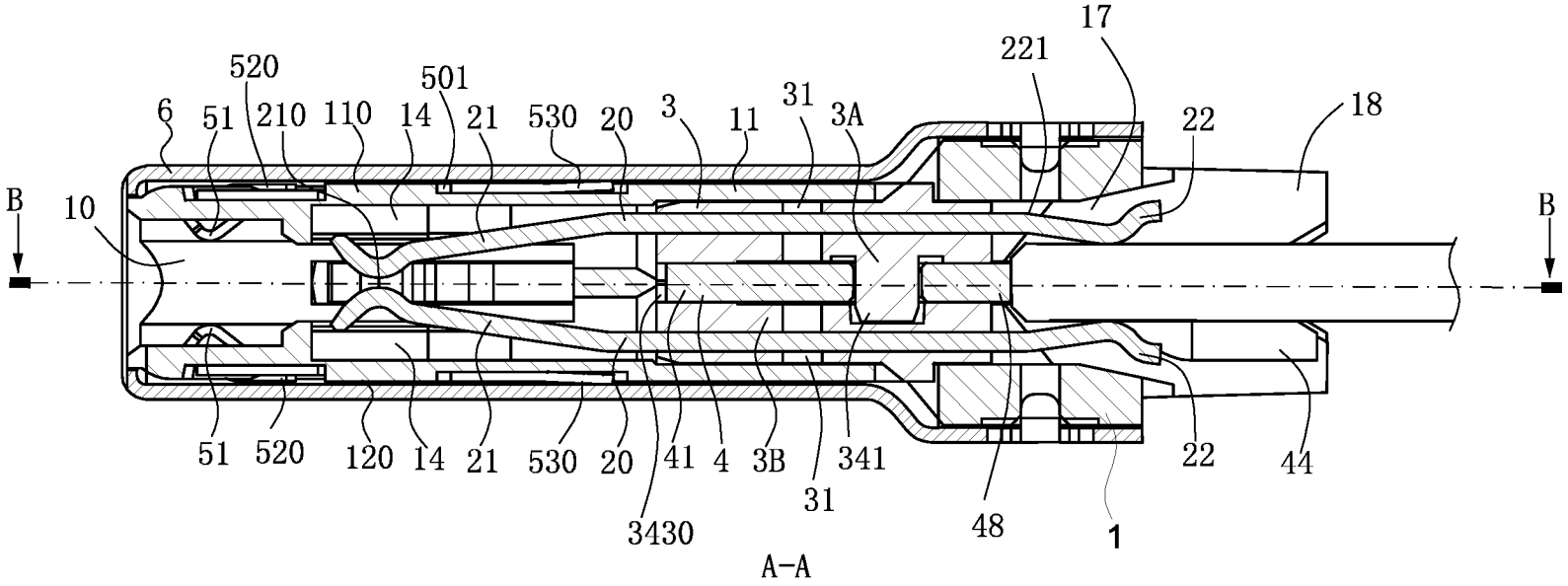
FIG. 3 is a sectional view of the electrical connector of FIG. 2 along line A-A.

Referring to FIG. 1, FIG. 2 and FIG. 3, an electrical connector 100 according to an embodiment of the present invention is provided. The electrical connector 100 of the present embodiment is a type-C plug connector. The electrical connector 100 is mated forward with a socket connector 200 and mounted backward to a circuit board 300. The electrical connector 100 includes an insulating body 1. A first terminal module M1, a second terminal module M2 and a shielding sheet 4 are accommodated in the insulating body 1. The shielding sheet 4 is located between the first terminal module M1 and the second terminal module M2. Two grounding sheets 5 are formed to be 180° vertically symmetrical, and respectively cover an upper surface and a lower surface of the insulating body 1. A metal shell 6 wraps outside the two grounding sheets 5 and the insulating body 1.

Referring to FIG. 1, FIG. 2 and FIG. 3, a front end of the insulating body 1 is concavely provided and formed with a mating cavity 10 to mate with the socket connector 200. The mating cavity 10 is formed by an upper plate 11, a lower plate 12 and two side plates 13 connecting the upper plate 11 and the lower plate 12. An upper surface of the upper plate 11 protrudes upward to form an upper protruding portion 110, a lower surface of the lower plate 12 protrudes to form a lower protruding portion 120, and the upper protruding portion 110 and the lower protruding portion 120 are provided to be vertically symmetrical. Each of the side plates 13 has a channel 130 provided therethrough, and the channel 130 is in communication with the mating cavity 10. Multiple terminal slots 14 are divided into two vertically symmetrical rows, and are respectively provided on the upper plate 11 and the lower plate 12. Each of the terminal slots 14 is in communication with the mating cavity 10. The terminal slots 14 in the upper row do not run upward through the upper plate 11, and the terminal slots 14 in the lower row do not run downward through the lower plate 12. The upper protruding portion 110 is adjacent to the front ends of the terminal slots 14 in the upper row, and the lower protruding portion 120 is adjacent to the front ends of the terminal slots 14 in the lower row. Multiple perforated holes 15 are provided on the upper plate 11 and the lower plate 12 and respectively form an upper row and a lower row. The perforated holes 15 in the upper row run through the upper plate 11, the perforated holes 15 in the lower row run through the lower plate 12, and each of the perforated holes 15 is located in front of all the terminal slots 14. A non-perforated hole 16 is provided between every two adjacent perforated holes 15 in the same row. Each of the non-perforated holes 16 in the upper row does not run through the upper plate 11, and each of the non-perforated holes 16 in the lower row does not run through the lower plate 12.

A rear end of the insulating body 1 is concavely provided and formed with an accommodating cavity 17, and the circuit board 300 is inserted into the accommodating cavity 17. Two side walls 18 respectively extend from two sides of the rear end of the insulating body 1. Each of the side walls 18 has a through hole 180 running outward therethrough, and the through hole 180 communicates an outer environment with the accommodating cavity 17.

Figure 6:
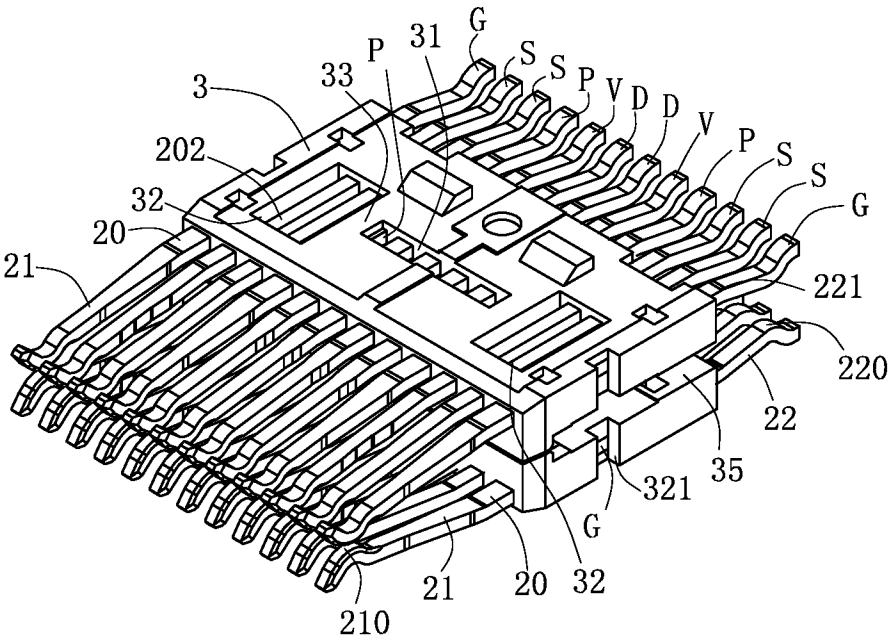
FIG. 6 is a perspective view of the first terminal module, the second terminal module and the middle shielding sheet of the electrical connector of FIG. 1 after assembling.
Figure 7:
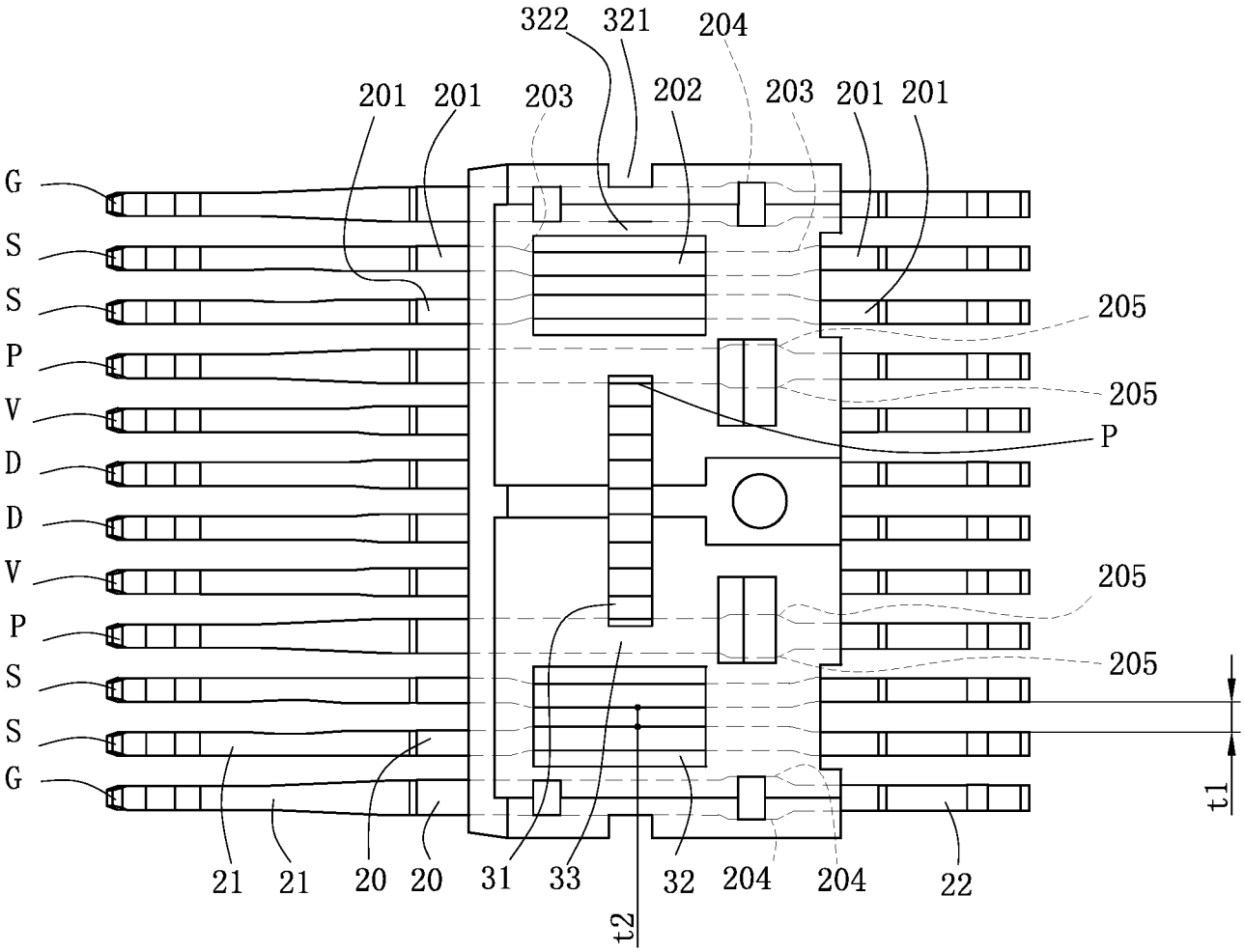
FIG. 7 is a top view of the first terminal module of FIG. 3.

Referring to FIG. 1, FIG. 6 and FIG. 7, multiple terminals 2 are provided in an upper row and a low row to be 180° symmetrical. Specifically, the 180° symmetry in the present invention refers to complete overlapping after a 180° turnover. There are 12 terminals 2 in each row, including, sequentially from left to right, a ground terminal G (non-high-speed terminal), a pair of differential signal terminals S (high-speed terminals) for transmitting USB 3.0 signals, a power terminal P (non-high-speed terminal), a reserved terminal V (non-high-speed terminal), a pair of USB 2.0 terminals D (non-high-speed terminals), a reserved terminal V (non-high-speed terminal), a power terminal P (non-high-speed terminal), a pair of differential signal terminals S (high-speed terminals) for transmitting USB 3.0 signals, and a ground terminal G (non-high-speed terminal). The reserved terminals V may be used for detection, or may be used as signal or power terminals.

Figure 9:
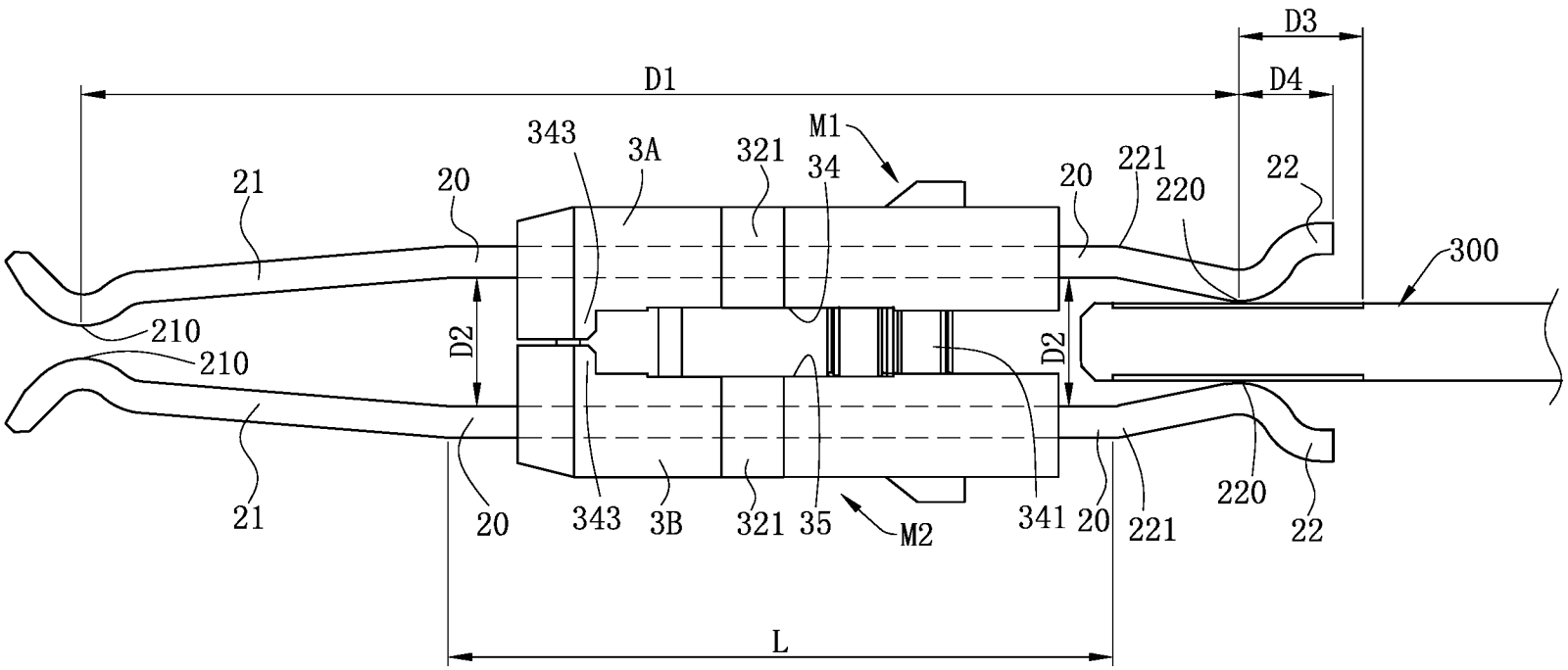
FIG. 9 is a side view of the first terminal module and the second terminal module after assembling.

Referring to FIG. 7 and FIG. 9, each terminal 2 has a connecting portion 20. The connecting portions 20 of the terminals 2 are located on a same horizontal plane in a front-rear direction, and a length L of each connecting portion 20 in the front-rear direction is 4.31±0.2 mm. The connecting portion 20 of each differential signal terminal S has two first sections 201 located at a front end and a rear end of the connecting portion 20, a second section 202 located between the two first sections 201, and two transition sections 203 connected to the two first sections 201 at two ends of the second section 202 respectively. A distance t2 between two adjacent second sections 202 is smaller than a distance t1 between two adjacent first sections 201. A first bump 204 protrudes outward from each of two sides of the connecting portion 20 of each ground terminal G, and one of the first bumps 204 adjacent to the differential signal terminal S protrudes toward the second section 202 of the adjacent differential signal terminal S, thereby reducing the distance between the ground terminal G and the adjacent differential signal terminal S. A second bump 205 protrudes outward from each of two sides of the connecting portion 20 of each power terminal P. The two second bumps 205 increase the area of the power terminal P and facilitate transmission of more currents. The first bumps 204 and the second bumps 205 are arranged in a row in a left-right direction.

Referring to FIG. 1, FIG. 7 and FIG. 9, a first conduction portion 21 bends and extends forward from the front end of the connecting portion 20 along the vertical direction, and a second conduction portion 22 bends and extends backward from the rear end of the connecting portion 20 along the vertical direction. The second conduction portion 22 has a bending portion 221 connected to the connecting portion 20. A tail end of the first conduction portion 21 is arc-shaped to form a first contact point 210. The first contact point 210 of each terminal 2 in the upper row is arched downward, and the first contact point 210 of each terminal 2 in the lower row is arched upward. The first contact point 210 is in mechanical contact with the socket connector 200. A tail end of the second conduction portion 22 is arc-shaped to form a second contact point 220. The second contact point 220 of each terminal 2 in the upper row is arched downward, and the second contact point 220 of each terminal 2 in the lower row is arched upward. Each terminal 2 has the following characteristics: a distance between the first contact point 210 and the connecting portion 20 in the vertical direction is greater than a distance between the second contact point 220 and the connecting portion 20 in the vertical direction, and a distance D1 between the first contact point 210 and the second contact point 220 is 7.46±0.4 mm. A distance D2 between the connecting portion 20 of each terminal 2 in the upper row and the connecting portion 20 of a corresponding terminal 2 in the lower row in the vertical direction is 1.02±0.2 mm.

Figure 5:
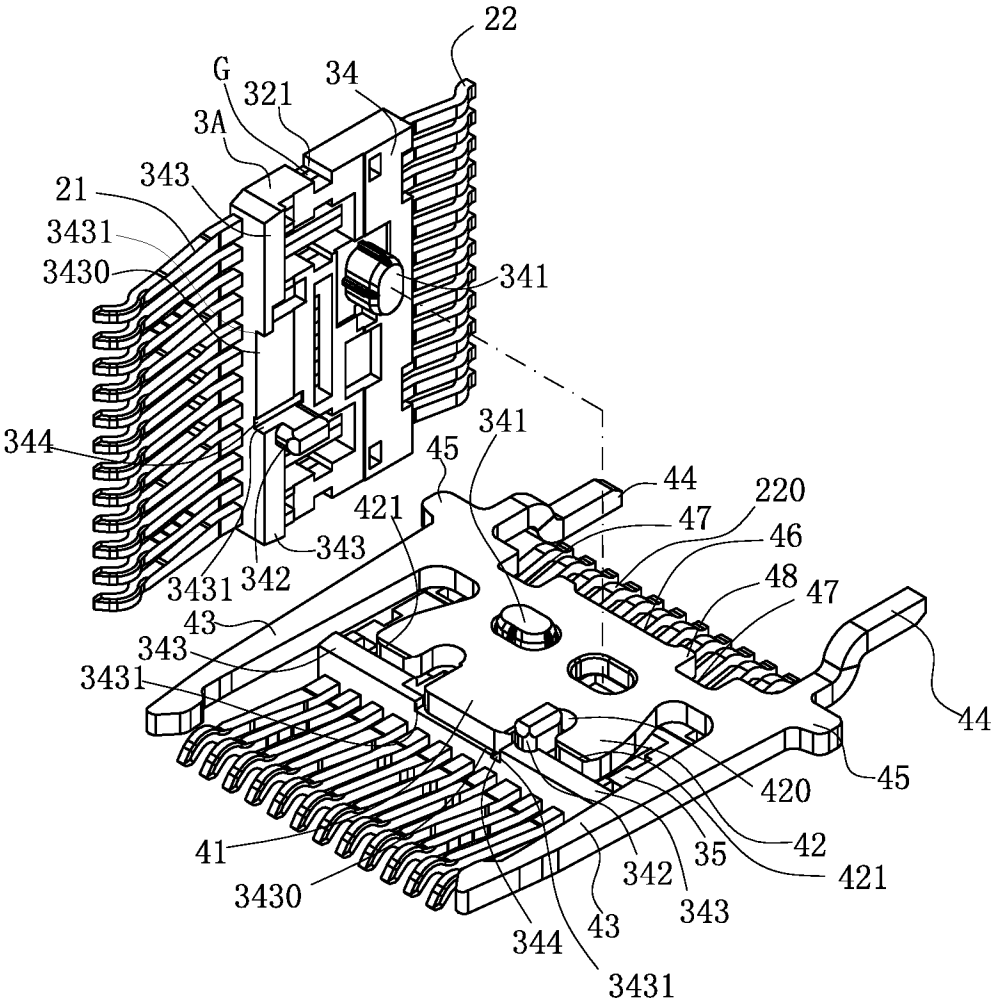
FIG. 5 is a perspective view of a first terminal module, a second terminal module and a middle shielding sheet of the electrical connector of FIG. 1.

Referring to FIG. 5, FIG. 6 and FIG. 9, an insulating block 3 is formed by an upper insulating block 3A and a lower insulating block 3B. The upper insulating block 3A and the lower insulating block 3B vertically match each other and are provided to be 180° symmetrical.

The first terminal module M1 is formed by the terminals 2 in the upper row and an upper insulating block 3A. The connecting portions 20 of the terminals in the upper row are injection molded and embedded into the upper insulating block 3A by insert-molding. The embedding length of the connecting portion 20 of each of the differential signal terminals S in the upper insulating block 3A is 3.2±0.2 mm, and the embedding length of the connecting portions 20 of each of the other terminals in the upper insulating block 3A is 3.45±0.2 mm. The front end of each connecting portion 20 extends out of a front surface of the upper insulating block 3A, and a distance between the first conduction portion 21 and the front surface of the upper insulating block 3A is 3.55±0.2 mm. The rear end of each connecting portion 20 extends out of a rear surface of the upper insulating block 3A, and a distance between the tail end of the second conduction portion 22 and the rear surface of the upper insulating block 3A is 1.75±0.2 mm.

Referring to FIG. 6, FIG. 7 and FIG. 9, the upper insulating block 3A has a first groove 31 and two second grooves 32 located on two sides of the first groove 31. A partition spacer 33 is formed between each second groove 32 and the first groove 31, and a width of each partition spacer 33 is smaller than a width of the connecting portion 20 of the power terminal P. The first groove 31 and the second grooves 32 all run through the upper surface and the lower surface of the upper insulating block 3A. The size of the first groove 31 is smaller than the size of each second groove 32 in the front-rear direction. The size of each second groove 32 in the front-rear direction is approximately equal to half of the size of the upper insulating block 3A in the front-rear direction. The size of the first groove 31 in the left-right direction is greater than the size of each second groove 32 in the left-right direction.

A positioning slot 321 is concavely provided on each of two sides of the upper insulating block 3A. The positioning slots 321 and the first groove 31 are located in the same straight line in the left-right direction, and have equal size in the front-rear direction.

Referring to FIG. 6, FIG. 7 and FIG. 9, the two power terminals P and the two reserved terminals V and the pair of USB 2.0 terminals located between the two power terminals P are exposed in the first groove 31. The connecting portion 20 of each of the power terminals P is embedded into a corresponding one of the partition spacers 33, and the power terminals P are partially embedded into the partition spacers 33. One side of each power terminal P protrudes and extends into the first groove 31, that is, the upper surface and the lower surface of each power terminal P as well as one of the side surfaces connecting the upper surface and the lower surface thereof are exposed in the first groove 31, thereby facilitating heat dissipation of the power terminals P. Moreover, the two sides of each power terminal P are exposed in air, facilitating that the side surfaces of each power terminal P can be fixed by a clamp in an injection molding process, thereby facilitating the positioning of the power terminals P. Each pair of differential signal terminals S is correspondingly exposed in each second groove 32, and a projection of the front wall surface of each second groove 32 in the vertical direction is on a joint between the transition section 203 and the second section 202. The second section 202 is exposed in air. Since the distance between the differential signal terminals S in pair is reduced from t1 to t2 at the joint between the transition section 203 and the second section 202, a dielectric coefficient needs to be reduced correspondingly to maintain the stability of impedance. The second groove 32 is full of air, and the dielectric coefficient of the air is smaller than the dielectric coefficient of the upper insulating block 3A. Therefore, by providing the front wall surface of each second groove 32 at the joint between the transition section 203 and the second section 202 of each differential signal terminal S, the stability of impedance can be effectively maintained.

Furthermore, since the row of the terminals 2 are respectively exposed in the first groove 31 and the second grooves 32 filled with air, the dielectric constant decreases in the first groove 31 and the second grooves 32. It can be known from a simple capacitance formula: $C=(\varepsilon S)/d$, where C is the capacitance, ε is the dielectric constant, S is the normal area of the two terminals transmitting the signal, and d is the distance between the two terminals transmitting the signal. The size of the second groove 32 in the front-rear direction is approximately equal to one-half of the size of the upper insulating block 3A in the front-rear direction, and is greater than the size of the first groove 31 in the front-rear direction, such that the second section 202 is exposed in the air, thereby ensuring the wrapping and fixing effects of the upper insulating block 3A on the connecting portion 20, ensuring the area of the connecting portion 20 exposed in the air, reducing the capacitance between one pair of differential signal terminals S, reducing the crosstalk between the other pair of differential signal terminals S, and facilitating the high-frequency characteristics of the electrical connector.

The side surface of each ground terminal G is exposed at the bottom of a corresponding positioning slot 321, facilitating that the side surface of each ground terminal G can be fixed by a clamp in an injection molding process, thereby facilitating the positioning of the ground terminals G.

Referring to FIG. 3, FIG. 5 and FIG. 9, the lower surface of the upper insulating block 3A forms an upper matching surface 34. A positioning post 341 and a position limiting protrusion 342 located in front of the positioning post 341 integrally extend downward from the upper matching surface 34. The position limiting protrusion 342 is provided along the front-rear direction elongatedly, and extends to the front surface of the upper insulating block 3A. A height of the position limiting protrusion 342 is greater than a height of the positioning post 341. In this embodiment, the height of the position limiting protrusion 342 is greater than the height of the positioning post 341 by 0.03 mm. A stopping portion 343 extends downward from each of the left and right sides of the upper matching surface 34. Each stopping portion 343 also extends forward to the front surface of the upper insulating block 3A, and the two stopping portions 343 are provided at an interval in the left-right direction to define an opening 3430, and the opening 3430 extends to the front surface of the upper insulating block 3A. Each of the stopping portions 343 has a position limiting surface 3431 facing the opening 3430. The position limiting protrusion 342 is located behind a corresponding one of the stopping portions 343 and connected forward to the corresponding stopping portion 343, and the position limiting surface 3431 extends backward to the position limiting protrusion 342 to form the side surface of the position limiting protrusion 342. A protection slot 344 is concavely provided and formed on the upper matching surface 34. The protection slot 344 is located above the position limiting protrusion 342 and the stopping portion 343. The position limiting surface 3431 extends upward to the protection slot 344 to form the side wall of the protection slot 344, and the protection slot 344 runs forward through the front surface of the upper insulating block 3A.

The second terminal module M2 is formed by a lower insulating block 3B and the terminals 2 in the lower row being integrally injection molded. The second terminal module M2 and the first terminal module M1 are 180° longitudinally symmetrical to each other, such that the upper surface of the lower insulating block 3B forms a lower matching surface 35. The upper insulating block 3A and the lower insulating block 3B fix and match with each other vertically, and the upper matching surface 34 and the lower matching surface 35 are provided opposite to each other vertically. The lower insulating block 3B and the upper insulating block 3A are 180° structurally symmetrical, and details are not elaborated herein.

Figure 10:
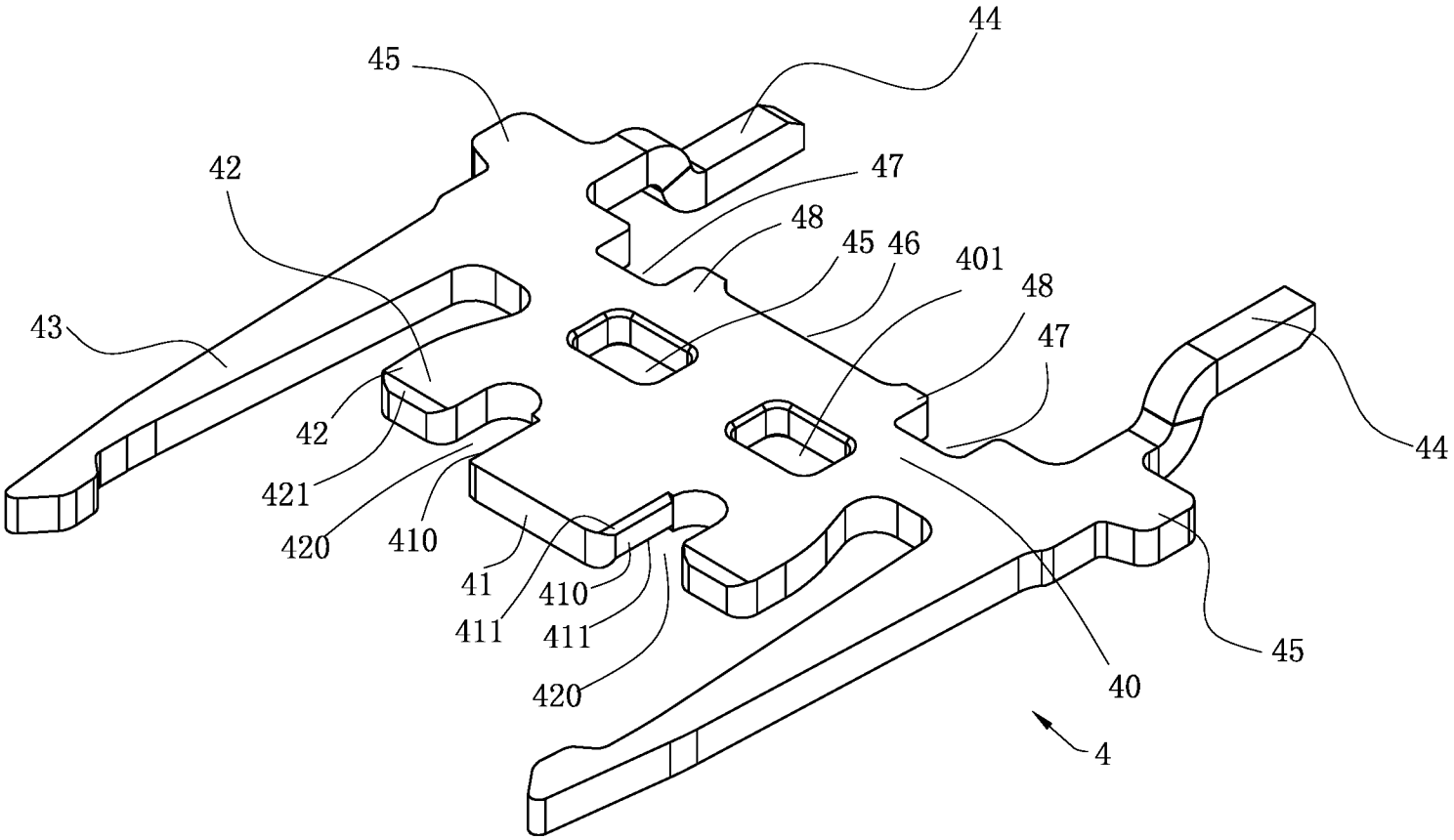
FIG. 10 is a perspective view of the shielding sheet of FIG. 1.

Referring to FIG. 1, FIG. 5 and FIG. 10, a shielding sheet 4 is formed by stamping from a metal sheet metal. The shielding sheet 4 has a base 40, and the base 40 has two positioning holes 401 thereon. A first protruding portion 41 extends forward from a center of a front end of the base 40, and two second protruding portions 42 are located at the left and right sides of the first protruding portion 41. The first protruding portion 41 passes a central line of the shielding sheet 4 in the front-rear direction. A notch 420 is formed between each second protruding portion 42 and the first protruding portion 41. Two side surfaces of the first protruding portion 41 form two stopping surfaces 410. Each of the stopping surface 410 is provided with an upper end and a lower end thereof, and each of the upper end and the lower end thereof is respectively provided with a first chamfer 411. Each of an upper end and a lower end of a front end surface of each of the second protruding portions 42 is respectively provided with a second chamfer 421.

Referring to FIG. 1, FIG. 5 and FIG. 10, the shielding sheet 4 has two latch arms 43, two pins 44 and two fastening portions 45. The two latch arms 43 extend forward from each of two sides of a rear end of the base 40 respectively. The two pins 44 extend backward from the left and right sides of the rear end of the base 40 respectively. A middle slot 46 and two side slots 47 located on two sides of the middle slot 46 are concavely provided on a rear end surface of the base 40. The middle slot 46 passes through the central line of the shielding sheet 4 in the front-rear direction. A concave depth of the middle slot 46 is less than a concave depth of each side slot 47. Each of the side slots 47 and the middle slot 46 define an abutting portion 48. The abutting portion 48 protrudes relative to a bottom of the middle slot 46 and bottoms of the side slots 47. The middle slot 46, the side slots 47 and the abutting portions 48 are all located between the two pins 44. Further, the two fastening portions 45 horizontally extend outward from each of the left and right sides of the rear end of the base 40 respectively. The middle slot 46, the side slots 47 and the abutting portions 48 are all located between the two fastening portions 45. An elastic space is formed between the latch arms 43 and the base 40 to reserve for the elastic deformation of the latch arms 43. The pin 44 and the latch arm 43 on the same side of the shielding sheet 4 pass through the same straight line in the front-rear direction. One of the pins 44 bends upward, and the other pin 44 bends downward.

Referring to FIG. 1, FIG. 2 and FIG. 3, each grounding sheet 5 has a main body portion 50. The main body portion 50 has a buckling groove 501, and multiple first extending arms 51 and multiple second extending arms 52 extend forward from the main body portion 50. The first extending arms 51 and the second extending arms 52 are arranged in a row and are provided alternately. Each first extending arm 51 bends to be arc-shaped along the vertical direction. Each second extending arm 52 extends horizontally, and each second extending arm 52 is provided with a first elastic sheet 520 formed by tearing. The first elastic sheet 520 bends along the vertical direction, and a free end thereof faces backward. Multiple second elastic sheets 530 extend backward from the tail end of the main body portion 50. The second elastic sheets 530 are arranged in a row at equal intervals. Each second elastic sheet 530 bends along the vertical direction, and a free end thereof faces backward.

Referring to FIG. 1, FIG. 2 and FIG. 3, the metal shell 6 is a cylindrical structure running through in the front-rear direction, and is made of metal. Referring to FIG. 3, the insulating block 3 is accommodated in the insulating body 1, and the insulating body 1 extends backward to pass beyond a rear end of the insulating block 3. Further, the metal shell 6 also extends backward to pass beyond the rear end of the insulating block 3.

Referring to FIG. 3, FIG. 5 and FIG. 6, the first terminal module M1 and the second terminal module M2 are mounted and fixed together vertically, and the shielding sheet 4 is clamped between the upper matching surface 34 and the lower matching surface 35. The base 40, the first protruding portion 41 and the second protruding portions 42 are clamped and attached fixedly between the upper matching surface 34 and the lower matching surface 35. The position limiting protrusions 342 are first accommodated in the notches 420, and then the positioning post 341 is accommodated and fastened in the positioning hole 401. The height of each position limiting protrusion 342 is greater than the height of the positioning post 341, such that the position limiting protrusions 342 can match with the notches 420 first to preliminarily position the shielding sheet 4, thereby allowing the positioning post 341 to more easily enter the positioning hole 401, thus facilitating mounting and reducing the mounting error.

Referring to FIG. 3, FIG. 5 and FIG. 6, the stopping portions 343 are correspondingly located in front of the second protruding portions 42 at the two sides to stop the second protruding portions 42 from moving forward. The arrangement of the second chamfers 421 reduces the sharp corners of the second protruding portions 42, thereby avoiding scratching of the stopping portions 343, protecting the upper insulating block 3A and reducing the generation of mounting scraps. The position limiting protrusion 342 of the upper insulating block 3A and the position limiting protrusion 342 of the lower insulating block 3B are located at two sides of the first protruding portion 41, the front end of the first protruding portion 41 is accommodated in the opening 3430 but does not pass beyond the front surface of the insulating block 3, and the front end of the first protruding portion 41 is exposed in the opening 3430. The stopping surfaces 410 and the position limiting surfaces 3431 are provided opposite to each other face-to-face. The arrangement of the second chamfers 421 prevents the sharp corners of the stopping surfaces 410 from scratching the position limiting surfaces 3431 and reduces the generation of the mounting scraps. A projection of the protection slot 344 in the vertical direction overlaps with a projection of the stopping surfaces 410 in the vertical direction. When the stopping surfaces 410 scrap the position limiting surfaces 3431 due to burrs formed by stamping, the protection slot 344 can receive the mounting scraps, thus avoiding the contamination of the mounting scraps, and thereby protecting the electrical connector 100. When the position limiting protrusions 342 limit the first protruding portion 41 from moving leftward or rightward, the opening 3430 facilitates heat dissipation of the first protruding portion 41. The rear end of the base 40 extends out of the rear surface of the upper insulating block 3A and the rear surface of the lower insulating block 3B, and is located between the second conduction portions 22 in the upper row and the lower row.

Figure 4:
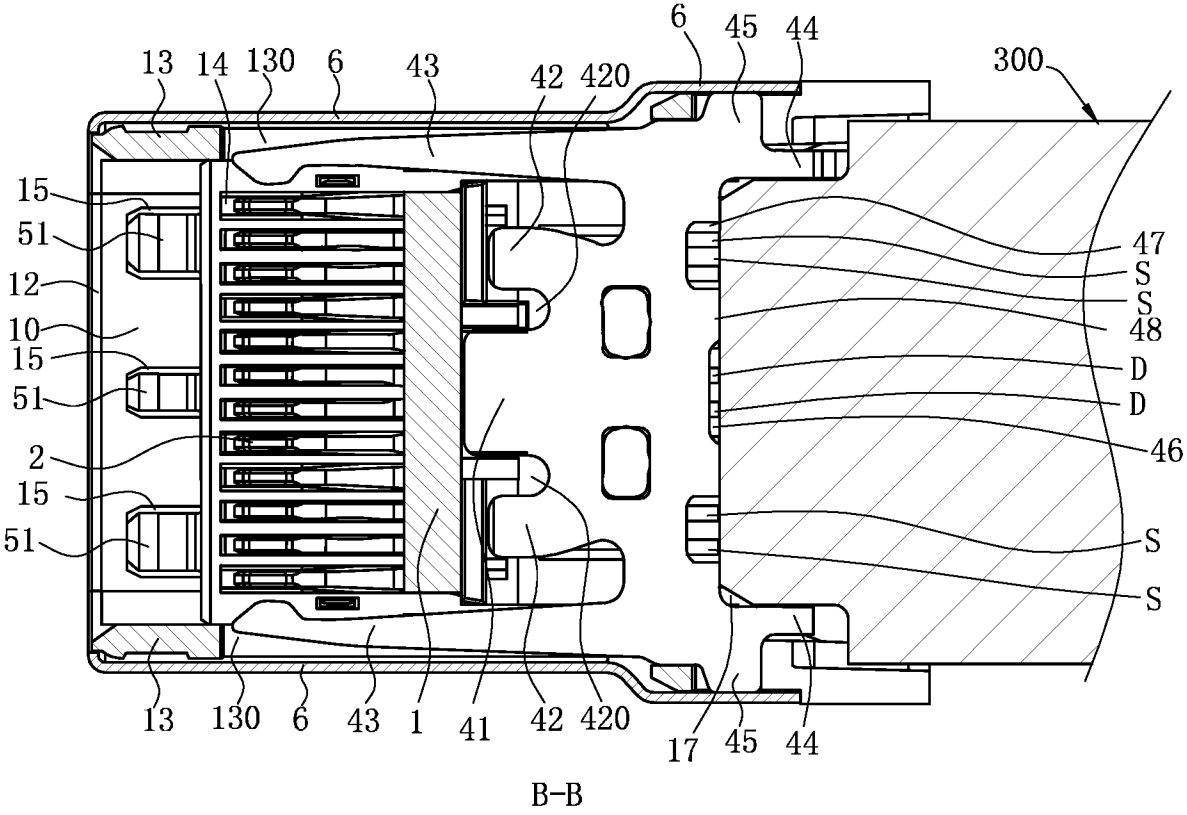
FIG. 4 is a sectional view of the electrical connector of FIG. 3 along line B-B.
Figure 8:
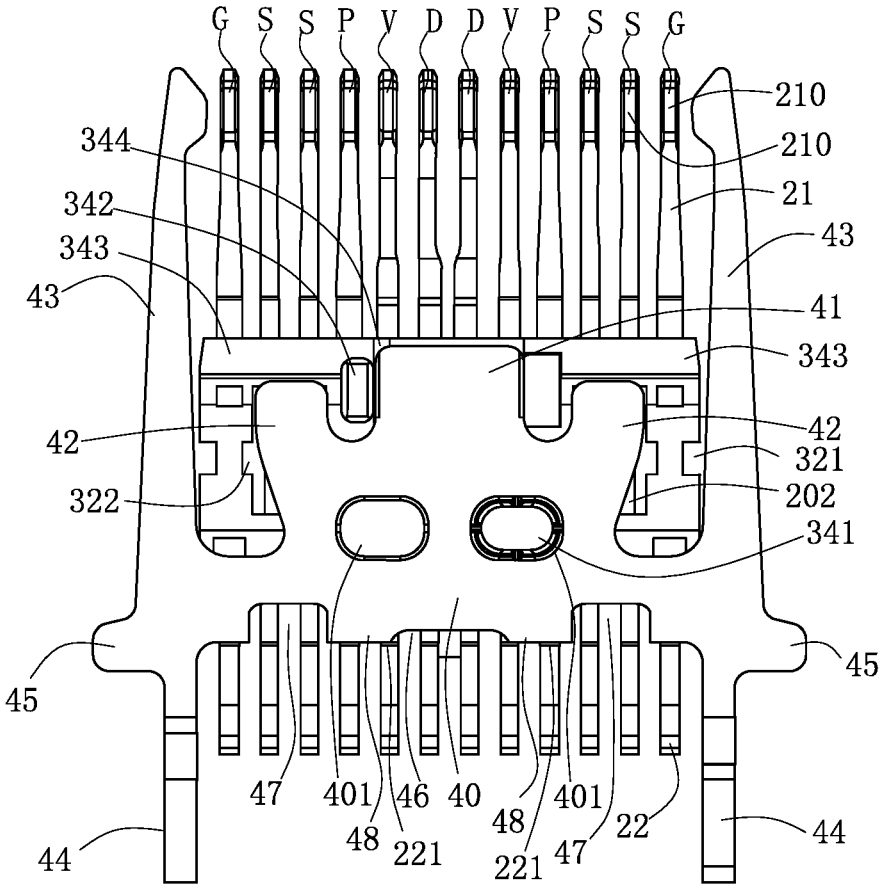
FIG. 8 is a top view of the second terminal module and the middle shielding sheet of FIG. 3.

Referring to FIG. 4 and FIG. 8, the first groove 31 is covered by the base 40 in the vertical direction, facilitating the reduction of crosstalk interference between two pairs of USB 2.0 terminals D vertically provided and exposed in the first groove 31. Each second groove 32 is covered by the base 40 and the corresponding second protruding portion 42 in the vertical direction, thereby facilitating the reduction of crosstalk interference between two pairs of differential signal terminals S vertically provided and exposed in each second groove 32.

Referring to FIG. 4 and FIG. 8, the latch arms 43 and the fastening portions 45 are exposed to the side surfaces of the insulating block 3. The two pins 44, the middle slot 46, the side slots 47 and the abutting portions 48 are exposed at the rear of the insulating block 3, and each abutting portion 48 does not pass backward beyond the bending portion 221, thereby reducing the crosstalk interference between the upper and lower rows of the second conduction portions 22.

Viewing downward from top thereof, the upper and lower rows of the second conduction portions 22 are located between the two pins 44. The middle slot 46 corresponds to the second conduction portions 22 of the upper and lower rows of the USB 2.0 terminals D to increase the terminal normal area between the upper and lower rows of the USB 2.0 terminals D, thereby adjusting the impedance of the terminals 2. Each of the side slot 47 corresponds to the second conduction portions 22 of one pair of differential signal terminals S to increase the terminal normal area between the upper and lower rows of the differential signal terminals S, thereby adjusting the impedance of the terminals 2. Each of the abutting portion 48 is provided corresponding to the power terminal D and the reserved terminal V on the same side. Referring to FIG. 1, FIG. 3 and FIG. 4, the first terminal module M1, the second terminal module M2 and the shielding sheet 4, when completely mounted, are inserted into the accommodating cavity 17 together from rear to front, and the upper insulating block 3A and the lower insulating block 3B are fixed in the accommodating cavity 17. Each first conduction portion 21 extends forward into the mating cavity 10, and the first conduction portions 21 correspond to multiple terminal slots 14. Each first conduction portion 21 can perform elastic deformation in the corresponding terminal slot 14, and the first contact point 210 protrudes out of the corresponding terminal slot 14 to be exposed in the mating cavity 10, and is in mechanical contact with the socket connector 200. Each second conduction portion 22 extends backward out of the accommodating cavity 17, and the second contact point 220 is located in the accommodating cavity 17.

The latch arms 43 are accommodated in the channels 130, and the tail end of each latch arm 43 enters the accommodating cavity 17 and is fastened and fixed to the socket connector 200 to form a ground loop. The fastening portions 45 are accommodated in the through holes 180, and each fastening portion 45 extends and protrudes from the corresponding side wall 18 in the left-right direction. The two pins 44 extend out of the rear end of the insulating body 1 and are located between the two side walls 18.

The two grounding sheets 5 are mounted on the upper plate 11 and the lower plate 12 respectively. When one of the grounding sheets 5 is mounted on the upper plate 11, the buckling groove 501 is sleeved on the periphery of an upper protruding block and is fastened to the upper protruding block. Each first extending arm 51 is accommodated downward in the perforated hole 15 of the upper plate 11, and the arc-shaped portion of each first extending arm 51 is exposed in the mating cavity 10. Each second extending arm 52 is accommodated in the non-perforated hole 16 of the upper plate 11, and the first elastic sheet 520 and the second elastic sheets 530 bend and extend upward respectively.

When the other of the grounding sheets 5 is mounted on the lower plate 12, the buckling groove 501 is sleeved on the periphery of a lower protruding block and is fastened to the lower protruding block. Each first extending arm 51 is accommodated upward in the perforated hole 15 of the lower plate 12, and the arc-shaped portion of each first extending arm 51 is exposed in the mating cavity 10. The first elastic sheet 520 and the second elastic sheets 530 located on the lower plate 12 bend and extend downward respectively.

A metal shell 6 is inserted outside the insulating body 1 and the two grounding sheets 5 from front to rear. The first elastic sheet 520 and the second elastic sheets 530 are in mechanical contact with the upper and lower inner surfaces of the metal shell 6, and the two fastening portions 45 abut the left and right inner surfaces of the metal shell 6. The fastening portions 45 have good rigidity and abut the inner surfaces of the metal shell 6.

Referring to FIG. 3, FIG. 4 and FIG. 9, the circuit board 300 is inserted forward into the accommodating cavity 17 and clamped between the second conduction portions 22 in the upper row and the lower row, and abuts the abutting portions 48. Two rows of first pads 301 are arranged on the upper and lower surfaces of the circuit board 300 respectively. Each first pad 301 is soldered and fixed to a corresponding second conduction portion 22, and the second contact point 220 is located in the middle of the corresponding first pad 301. A length of each first pad 301 in the front-rear direction is 1.5 mm, and a distance D3 between the second contact point 220 and a rear edge of the corresponding first pad 301 is 0.75±0.1 mm, thereby facilitating the soldering and fixing of the corresponding second conduction portion 22 on the first pad 301. Each abutting portion 48 does not pass backward beyond the bending portion 221, thereby ensuring the sufficient insertion depth for the circuit board 300, avoiding the excessively large distance between the second contact point 220 and the rear edge of the corresponding first pad 301, and increasing the transmission path length of electrical signals.

The tail end of each second conduction portion 22 does not pass backward beyond a rear edge of the first pad 301. A distance D4 between the second contact point 220 and the tail end of each second conduction portion 22 is 0.6±0.1 mm. Compared with the scenario where the tail end of each second conduction portion 22 extends backward beyond the rear edge of the first pad 301, the invalid conductive paths of the second conduction portions 22 in this embodiment are reduced, facilitating the reduction of an antenna effect, thereby improving the high-frequency characteristics. Four second pads 302 are arranged in two rows to be longitudinally symmetrical and are distributed on the upper and lower surfaces of the circuit board 300. The two second pads 302 in the upper row are located behind two sides of the first pads 301 in the upper row, and the two second pads 302 in the lower row are located behind two sides of the first pads 301 in the lower row. The two second pads 302 in the upper row are soldered and fixed to one of the pins 44, and the two second pads 302 in the lower row are correspondingly soldered and fixed to the other pin 44.

To sum up, the electrical connector assembly 100 according to certain embodiments of the present invention has the following beneficial effects:

1. The second conduction portion 22 has a bending portion 221 connected to the connecting portion 20. The abutting portions 48 are exposed at the rear of the insulating block 3 and located between the upper and lower rows of the second conduction portions 22, and each abutting portion 48 does not pass backward beyond the bending portion 221, thereby reducing the crosstalk interference between the upper and lower rows of the second conduction portions 22, ensuring the sufficient insertion depth for the circuit board 300, avoiding the excessively large distance between the second contact point 220 and the rear edge of the corresponding first pad 301, and increasing the transmission path length of electrical signals.

2. The middle slot 46 corresponds to the second conduction portions 22 of the upper and lower rows of the USB 2.0 terminals D to increase the terminal normal area between the upper and lower rows of the USB 2.0 terminals D, thereby adjusting the impedance of the terminals 2. Each of the side slot 47 corresponds to the second conduction portions 22 of one pair of differential signal terminals S to increase the terminal normal area between the upper and lower rows of the differential signal terminals S, thereby adjusting the impedance of the terminals 2.

3. The size of the second groove 32 in the front-rear direction is approximately equal to one-half of the size of the upper insulating block 3A in the front-rear direction, and is greater than the size of the first groove 31 in the front-rear direction, such that the second section 202 is exposed in the air, thereby ensuring the wrapping and fixing effects of the upper insulating block 3A on the connecting portion 20, ensuring the area of the connecting portion 20 exposed in the air, reducing the capacitance between one pair of differential signal terminals S, reducing the crosstalk between the other pair of differential signal terminals S, and facilitating the high-frequency characteristics of the electrical connector.

4. Each pair of differential signal terminals S is correspondingly exposed in each second groove 32, and a projection of the front wall surface of each second groove 32 in the vertical direction is on a joint between the transition section 203 and the second section 202. The second section 202 is exposed in air. Since the distance between the differential signal terminals S in pair is reduced from t1 to t2 at the joint between the transition section 203 and the second section 202, a dielectric coefficient needs to be reduced correspondingly to maintain the stability of impedance. The second groove 32 is full of air, and the dielectric coefficient of the air is smaller than the dielectric coefficient of the upper insulating block 3A. Therefore, by providing the front wall surface of each second groove 32 at the joint between the transition section 203 and the second section 202 of each differential signal terminal S, the stability of impedance can be effectively maintained.

5. The position limiting protrusions 342 are first accommodated in the notches 420, and then the positioning post 341 is accommodated and fastened in the positioning hole 401. The height of each position limiting protrusion 342 is greater than the height of the positioning post 341, such that the position limiting protrusions 342 can match with the notches 420 first to preliminarily position the shielding sheet 4, thereby allowing the positioning post 341 to more easily enter the positioning hole 401, thus facilitating mounting and reducing the mounting error.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector configured to electrically connect a first component and a second component, the electrical connector comprising:

an insulating block;

a plurality of terminals, provided to form two rows including an upper row and a lower row, each of the terminals having a connecting portion fixed in the insulating block, a first conduction portion extending forward from the connecting portion to be electrically connected to the first component, and a second conduction portion extending backward from the connecting portion, wherein the second conduction portion has a bending portion, and the bending portion is connected to the connecting portion; and a shielding sheet, fixed to the insulating block and located between the two rows of the terminals, wherein a rear end of the shielding sheet has an abutting portion to abut the second component, and the abutting portion extends backward out of an insulating block and does not pass beyond the bending portion;

wherein the second component is inserted forward between the second conduction portions of the terminals in the upper row and the lower row, the second component has a plurality of first pads divided into an upper row and a lower row and provided on an upper surface and a lower surface of the second component, each of the first pads is correspondingly in contact with the second conduction portion of a corresponding one of the terminals, and a tail end of the second conduction portion of the corresponding one of the terminals does not pass backward beyond a rear edge of each of the first pads;

wherein the second conduction portion has a contact point in contact with a corresponding first pad of the first pads, a distance from the second contact point to the rear edge of the corresponding first pad is 0.75±0.1 mm, and a distance from the second contact point to the tail end of the second conduction portion is 0.6±0.1 mm.

2. The electrical connector according to claim 1, wherein the insulating block is accommodated in an insulating body, the insulating body extends backward to pass beyond a rear end of the insulating block, the shielding sheet has a base, the base has a positioning hole fixed to and matched with the insulating block, and a rear end of the base has the abutting portion abutting and in contact with the second component.

3. The electrical connector according to claim 2, wherein two latch arms respectively extend forward from two sides of the base and are configured to latch and fit with the first component, two pins respectively extend from two sides of a rear end of the base to be in electrical contact with the second component, one of the latch arms and one of the pins located on a same side pass through a straight line in a front-rear direction, and the abutting portion is located between the two pins.

4. The electrical connector according to claim 3, further comprising a metal shell provided in a cylindrical shape and sleeved outside the insulating block, wherein the metal shell extends backward to pass beyond the rear end of the insulating block, two fastening portions respectively protrude from the two sides of the base toward a left side and a right side, and the fastening portions abut the metal shell.

5. An electrical connector configured to electrically connect a first component and a second component, the electrical connector comprising:

an insulating block;

a plurality of terminals, provided to form two rows including an upper row and a lower row, including a plurality of USB 2.0 terminals in the upper row and the lower row and one pair of differential signal terminals, each of the terminals having a connecting portion fixed in the insulating block, a first conduction portion extending forward from the connecting portion to be electrically connected to the first component, and a second conduction portion extending backward from the connecting portion, wherein the second conduction portion has a bending portion, and the bending portion is connected to the connecting portion; and a shielding sheet, fixed to the insulating block and located between the two rows of the terminals, wherein a rear end of the shielding sheet has an abutting portion to abut the second component, and the abutting portion extends backward out of an insulating block and does not pass beyond the bending portion;

wherein a middle slot and a side slot are concavely provided on a middle portion of a rear end surface of the shielding sheet, the side slot is located at one side of the middle slot, the middle slot corresponds to the second conduction portions of the upper row and the lower row of the USB 2.0 terminals, the side slot corresponds to the second conduction portions of the one pair of differential signal terminals, and the abutting portion is formed between the middle slot and the side slot.

6. The electrical connector according to claim 5, wherein a concave depth of the middle slot is less than a concave depth of the side slot.

7. The electrical connector according to claim 5, wherein the insulating block is accommodated in an insulating body, the insulating body extends backward to pass beyond a rear end of the insulating block, the shielding sheet has a base, the base has a positioning hole fixed to and matched with the insulating block, and a rear end of the base has the abutting portion abutting and in contact with the second component.

8. The electrical connector according to claim 7, wherein two latch arms respectively extend forward from two sides of the base and are configured to latch and fit with the first component, two pins respectively extend from two sides of a rear end of the base to be in electrical contact with the second component, one of the latch arms and one of the pins located on a same side pass through a straight line in a front-rear direction, and the abutting portion is located between the two pins.

9. The electrical connector according to claim 8, further comprising a metal shell provided in a cylindrical shape and sleeved outside the insulating block, wherein the metal shell extends backward to pass beyond the rear end of the insulating block, two fastening portions respectively protrude from the two sides of the base toward a left side and a right side, and the fastening portions abut the metal shell.

10. An electrical connector configured to electrically connect a first component and a second component, the electrical connector comprising:

an insulating block;

a plurality of terminals, provided to form two rows including an upper row and a lower row, each of the terminals having a connecting portion fixed in the insulating block, a first conduction portion extending forward from the connecting portion to be electrically connected to the first component, and a second conduction portion extending backward from the connecting portion, wherein the second conduction portion has a bending portion, and the bending portion is connected to the connecting portion; and a shielding sheet, fixed to the insulating block and located between the two rows of the terminals, wherein a rear end of the shielding sheet has an abutting portion to abut the second component, and the abutting portion extends backward out of an insulating block and does not pass beyond the bending portion;

wherein the shielding sheet has at least one positioning hole and at least one notch located in front of the positioning hole, the insulating block has an upper insulating block and a lower insulating block vertically matching each other, the upper insulating block has an upper matching surface facing the lower insulating block, the lower insulating block has a lower matching surface facing the upper insulating block, at least one positioning post and at least one position limiting protrusion are provided between the upper matching surface and the lower matching surface, the position limiting protrusion is located in front of the positioning post, the positioning post is accommodated in and fixed to the positioning hole, the position limiting protrusion is accommodated in the notch, and a height of the position limiting protrusion is greater than a height of the positioning post.

11. The electrical connector according to claim 10, wherein at least one stopping portion is located between the upper matching surface and the lower matching surface, and the stopping portion is at least partially located in front of the shielding sheet to stop the shielding sheet from moving forward.

12. The electrical connector according to claim 11, wherein two stopping portions are provided opposite to each other at an interval in a left-right direction, the two stopping portions form an opening running forward, and the shielding sheet is exposed in the opening.

13. The electrical connector according to claim 12, wherein the shielding sheet has a base, the positioning hole is provided on the base, a first protruding portion extends forward from the base, a second protruding portion is located on at least one side of the first protruding portion, the notch is formed between the first protruding portion and the second protruding portion, the first protruding portion is exposed in the opening, and the stopping portions are provided in front of the second protruding portion to stop the second protruding portion from moving forward.

14. The electrical connector according to claim 13, wherein the first protruding portion is partially accommodated in the opening, and the two stopping portions are located at a left side and a right side of the first protruding portion to stop the first protruding portion from moving in the left-right direction.

15. The electrical connector according to claim 13, wherein two second protruding portions are provided so as to form two notches corresponding to two position limiting protrusions, and the two position limiting protrusions are located at a left side and a right side of the first protruding portion to stop the first protruding portion from moving in the left-right direction.

16. The electrical connector according to claim 15, wherein a side surface of the first protruding portion forms a stopping surface facing one of the two position limiting protrusions, the one of the position limiting protrusions has a position limiting surface provided face-to-face with the stopping surface, a protection slot is concavely provided on the upper matching surface or the lower matching surface, a projection of the protection slot in a vertical direction overlaps with a projection of the first protruding portion in the vertical direction, and a side wall of the protection slot and the position limiting surface are located on a same plane.

17. The electrical connector according to claim 16, wherein the protection slot extends forward into the opening.

18. The electrical connector according to claim 17, wherein each of an upper edge and a lower edge of the stopping surface is respectively provided with a first chamfer.

19. The electrical connector according to claim 17, wherein each of an upper edge and a lower edge of a front end surface of each of the second protruding portions is respectively provided with a second chamfer.

* * * * *